United States Patent [19]

Gerson

[11] Patent Number: 5,009,716

[45] Date of Patent: Apr. 23, 1991

[54] BLANKET AND ROLLER WASH FOR PRINTING APPARATUS

[75] Inventor: David Gerson, Woodbridge, N.J.

[73] Assignee: Printers' Service, Inc., Newark, N.J.

[21] Appl. No.: 352,466

[22] Filed: May 16, 1989

[51] Int. Cl.[5] ..... B08B 3/08

[52] U.S. Cl. ..... 134/40; 134/38; 252/17.0

[58] Field of Search ..... 134/40, 38; 252/170

[56] References Cited

U.S. PATENT DOCUMENTS

| | | | |
|---|---|---|---|
| 1,750,990 | 4/1928 | Briel . | |
| 3,626,559 | 3/1970 | Rossmann . | |
| 3,773,677 | 11/1973 | Boyles | 134/40 |
| 3,955,986 | 5/1976 | Miller | 428/91 |
| 4,257,909 | 3/1981 | Christianson . | |
| 4,289,644 | 9/1981 | Steinhauer | 252/170 |
| 4,330,422 | 5/1982 | Tesch . | |
| 4,435,305 | 3/1984 | Tsoukalas | 252/170 |
| 4,504,406 | 3/1985 | Dhillon | 252/170 |
| 4,576,743 | 3/1986 | Kita et al. . | |
| 4,599,116 | 7/1986 | King et al. . | |
| 4,599,190 | 7/1986 | Maloney | 252/174.24 |
| 4,619,709 | 10/1986 | Fiocco . | |
| 4,747,977 | 5/1988 | Whitehead et al. | 252/111 |
| 4,769,170 | 9/1988 | Omori et al. | 252/117 |
| 4,784,777 | 11/1988 | Dellinger | 252/174.16 |
| 4,795,840 | 1/1989 | Torii | 208/143 |

*Primary Examiner*—Olik Chaudhuri
*Assistant Examiner*—Ourmazd Ojan
*Attorney, Agent, or Firm*—Fleit, Jacobson, Cohn, Price, Holman & Stern

[57] ABSTRACT

A blanket and roller wash for removing ink from printing press components. The blanket and roller wash has a very low, substantially zero percent, emmision of volatile organic compounds. The blanket and roller wash is a two-component composition containing a nonionic surfactant and a monobasic fatty acid having 12 to 20 carbon atoms or a three-component composition containing a saturated hydrocarbon oil of low viscosity in addition to the nonionic surfactant and the fatty acid. The invention further relates to methods of removing ink from printing rollers and blankets.

6 Claims, No Drawings

BLANKET AND ROLLER WASH FOR PRINTING APPARATUS

FIELD OF THE INVENTION

The present invention relates to a blanket and roller "wash", which is a composition for removing ink, particularly oleoresinous paste ink, from printing rollers and blankets. The blanket and roller wash of the present invention contributes a very low, emission of its substantially 0%, volatile organic content into the atmosphere.

BACKGROUND OF THE INVENTION

Traditionally, washes for components of lithographic or paste ink printing apparatus have been based on organic solvent mixtures having minor amounts of non-solvent ingredients incorporated therein. These organic solvent mixtures are completely or nearly completely volatile, with a volatile organic compounds (V.O.C.) into the atmosphere. Such conventional washes rely upon chemical solvation to remove ink from printing press components.

Currently, blanket and roller washes for lithographic presses consist primarily of hydrocarbon mixtures of both aromatic and aliphatic compounds, with the possible addition of smaller quantities of chlorinated hydrocarbons, ketones, alcohols, amides, esters, surfactants or glycol ethers. All of these materials are classified as volatiles, for purposes of determining V.O.C. for air pollution standards, with the exception of chlorinated hydrocarbons and surfactants. These hydrocarbon mixtures are either flammable or combustible, and will undesirably swell rubber rollers and blankets to some extent. In addition, these conventional hydrocarbon mixtures may be irritating or corrosive to the skin and other body tissues.

Other types of blanket and roller washes for lithographic presses have also been proposed. For example, soap/solvent combinations have been suggested; however, such soap/solvent combinations have an undesirably high level of highly volatile V.O.C.'s. In addition, blanket and roller washes containing water and non-petroleum solvents have been proposed. However, although the water/non-petroleum solvent washes represent an attempt at increasing the flash point and decreasing the V.O.C. of a wash by the addition of water, such water/non-petroleum solvent washes have proven to be unsatisfactory.

Therefore, it is an object of the present invention to provide a blanket and roller wash for removing inks, particularly oleophylic or oleoresinous paste ink, from blankets and roller trains on a press, which blanket and roller wash does not suffer from the disadvantages of prior washes.

Another object of the present invention is to provide a blanket and roller wash having a very low, substantially 0%, emission of its volatile organic content.

It is yet another object of the present invention to provide a blanket and roller wash which removes ink from blankets and roller trains on a printing press by diluency and detergency rather than solvation.

Still another object of the present invention is to provide a blanket and roller wash which will not swell rubber blankets and rollers.

Still a further object of the present invention is to provide a blanket and roller wash which is not corrosive or irritating to the skin or other body tissues.

Finally, it is an object of the present invention to provide improved methods of removing ink from blankets and roller trains of a printing press.

These and other objects of the present invention will be further understood by reference to the following description and examples.

SUMMARY OF THE INVENTION

The blanket and roller wash of the present invention has a very low, substantially 0%, emission of its volatile organic content (V.O.C.) and is particularly suitable for use in removing and washing oleophylic or oleoresinous paste inks off rubber printing rollers and blankets. In one embodiment, the inventive blanket and roller wash is a three-component composition comprising a saturated hydrocarbon oil having a viscosity no higher than 165 SSU at 100° F. and a vapor pressure no higher than 0.1 mm Hg at 20° C.; a nonionic surfactant having a hydrophilic/lipophilic balance (HLB) of 8.5 to 17.5; and a monobasic fatty acid of 12 to 20 carbon atoms. According to another embodiment of the present invention, there is provided a two-component blanket and roller wash comprising a monobasic fatty acid having 12 to 20 carbon atoms and a surfactant having an HLB of 8.5 to 17.5. The invention further relates to a method of washing paste ink off of rubber printing rollers and blankets comprising the use of a two-component or three-component blanket and roller wash of the present invention or using mineral oil alone.

DETAILED DESCRIPTION OF THE INVENTION

According to one embodiment of the present invention, there is provided a blanket and roller wash comprising a saturated hydrocarbon oil, a nonionic surfactant and a monobasic fatty acid. The saturated hydrocarbon oil has a viscosity no higher 165 SSU at 100° F. and a vapor pressure no higher than 0.1 mm Hg, preferably no higher than 0.01 mm Hg, at 20° C.

The nonionic surfactant has an HLB of 8.5 to 17.5. The nonionic surfactant is preferably a surfactant selected from the group consisting of straight chain and branched substituted polyalkoxylates, glycerol esters, laureate esters, stearate esters, tallowate esters, oleate esters and amides. An especially preferred nonionic surfactant is nonylphenoxypoly(ethyleneoxy)ethanol, which has an HLB of 13.6.

The monobasic fatty acid preferably comprises 12 to 20 carbon atoms, and preferably is a liquid fatty acid such as oleic or linoleic acid. Non-fluid fatty acids such as lauric and stearic acids are also suitable for use in the present invention.

The blanket and roller wash of the present invention preferably comprises, based on the total volume of the wash, 0 to 92% by volume saturated hydrocarbon oil, 7 to 97.25% by volume monobasic fatty acid, and at least 1% by volume nonionic surfactant.

The blanket and roller wash of the present invention is a clear, chemically and physically stable solution which applies easily to printing press rollers and blankets, penetrates the ink thereon, flushes the ink off of the roller and blanket surfaces and rinses completely with water. Unlike conventional washes, the inventive blanket and roller wash does not rely on chemical solvation to remove ink from the rollers and blankets. The blanket and roller wash of the invention acts by dilution and detergency.

The low viscosity hydrocarbon oil has a high degree of miscibility in all oleophylic or oleoresinous paste inks and will act as a diluent when applied to an inked roller or blanket. The nonionic surfactants useful in the inventive blanket and roller wash have a high detergency which couples the hydrocarbon oil component with water, thus allowing for complete removal of the blanket and roller wash and ink with plain water during blanket and roller clean-up. The nonionic surfactant is capable of emulsifying oil and water and the monobasic fatty acid acts as a coupling agent for the hydrocarbon oil in soluble surfactant and hydrocarbon oil thereby yielding a homogeneous mixture. The monobasic fatty acid couples the oil with the nonionic surfactant to yield a stable solution and to broaden the ink miscibility of the inventive blanket and roller wash.

The blanket and roller wash of the present invention has a vapor pressure below 0.1 mm Hg, and preferably below 0.01 mm Hg.

When the monobasic fatty acid component is a liquid fatty acid, the inventive blanket and roller wash is produced by adding the nonionic surfactant to the liquid fatty acid, and then adding the hydrocarbon oil to the fatty acid/surfactant mixture. However, when the fatty acid is a non-fluid fatty acid, such as lauric or stearic acid, the fatty acid and the hydrocarbon oil should be mixed until perfectly clear before the nonionic surfactant is added thereto.

It should be noted that the blanket and roller wash of the present invention will gell at temperatures approaching 32° F. When this occurs, the blanket and roller wash should be brought to room temperature until clarity is achieved, before using the blanket and roller wash to remove ink from printing apparatus.

The inventive blanket and roller wash can be used to remove ink from ink train rollers and/or printing press blankets in the same manner as prior, conventional blanket and roller washes.

To remove ink from printing ink train rollers, the inventive blanket an d roller wash is applied sparingly to the inked roller train while the rollers are turning. The blanket and roller wash is allowed to coat and penetrate the ink. After about one minute, a clean-up doctor blade or wash-up sheet is engaged with the surface of the turning rollers to remove material from that surface, and then small additional portions of the blanket and roller wash are applied to the surface of the turning rollers until the material being removed from the rollers by the doctor blade or wash-up sheet is coming off clear. Then, water is applied sparingly once or twice until the surface of the rollers is free of any oily residue.

To remove ink from a printing blanket, the blanket and roller wash is applied to a cloth rag or the like and then the cloth rag is wiped or rubbed over the printing blanket surface by hand, in a conventional cleaning manner. The residue is then wiped off with a water soaked rag.

It has been unexpectedly found that mineral oil alone, i.e., without any additives, is capable of effectively removing ink from printing blankets and rollers. To remove ink from an inked roller train or blanket, mineral oil can be used in the manner described above with reference to the use of the inventive blanket and roller wash. This approach will however leave a residue which will not wash off with water.

The following examples described specific, preferred embodiments of the inventive blanket and roller wash; however, these examples are set forth to illustrate the present invention and are not to be construed as limiting thereof.

EXAMPLE 1

This is an example of a three-component blanket and roller wash of the present invention. 2.75% by volume, based on the total volume of the final composition, of nonylphenoxypoly(ethyleneoxy)ethanol having an HLB of 13.6 and 9.25% by volume, based on the total volume of the final composition, of oleic acid were mixed. Then, 88% by volume, based on the total volume of the final composition, of a hydrogenated naphthenic mineral oil was added to the nonylphenoxypoly(ethyleneoxy)ethanol/oleic acid mixture. The hydrogenated naphthenic mineral oil had an initial boiling point of 238° C., a molecular weight of about 260 and a viscosity of 55 SSU at 100° F.

The resultant blanket and roller wash was a clear, chemically and physically stable solution which applied easily to printing press rollers and blankets, penetrated the ink, flushed the ink off of the roller and blanket surfaces, and rinsed completely with water.

EXAMPLE 2

This is another example of a three-component blanket and roller wash of the present invention. 2.75% by volume, based on the total volume of the final composition, of nonylphenoxypoly(ethyleneoxy)ethanol having an HLB of 13.6 and 47.25% by volume, based on the total volume of the final composition, of oleic acid were mixed. Then, 50% by volume, based on the total volume of the final composition, of a light weight oil which was free of additives and had a viscosity of 165 SSU at 100° F. was added to the nonylphenoxypoly(ethyleneoxy)ethanol/oleic mixture. The resultant blanket and roller wash was a clear, chemically and physically stable solution having properties similar to those of the blanket and roller wash of Example 1. The use of a heavier viscosity oil in this example was accommodated by increasing the relative proportion of the monobasic fatty acid, i.e., oleic acid.

EXAMPLE 3

This is an example of a two-component blanket and roller wash of the present invention. 97.25% volume, based on the total volume of the final composition, of a liquid fatty acid, either oleic or linoleic acid, was mixed with 2.75% by volume, based on the total volume of the final composition, of nonylphenoxypoly(ethyleneoxy)ethanol with an HLB of 13.6 were mixed to produce a blanket and roller wash. The resultant composition functioned satisfactorily as a blanket and roller wash for removing ink from printing rollers or blankets.

Although the present invention has been described by reference to specific embodiments thereof, it is to be understood that modifications may be made without departing from the scope of the present invention as described above and defined in the following claims.

What is claimed is:

1. A method for removing paste ink from printing rollers and blankets, comprising:

(a) applying a blanket and roller wash to an inked surface of a printing roller or blanket, wherein said wash consists essentially of at least 1% by volume of a nonionic surfactant having a hydrophilic/lipophilic balance of 8.5 to 17.5, 7–97.25% by volume of a monobasic fatty acid having 12 to 20 carbon atoms, and 0–92% by volume of a mineral oil selected from the group of saturated hydrocarbon oils that have a viscosity no higher than 165 SSU at 100° F. and a vapor pressure no higher than 0.1 mm Hg at 20° C.;

(b) allowing said wash to coat said surface and penetrate the ink thereon;

(c) removing material from said surface;

(d) applying additional portions of said wash to said surface until the material that is removed from said surface is substantially clear; and (e) applying water to said surface until said surface is free of any oily residue.

2. The method of claim 1, wherein paste ink is removed from printing rollers, said roller is turning during application of said wash in step (a).

3. The method of claim 1, wherein said ink is paste ink said surface is that of a printing blanket, said wash is applied to the inked surface with a cloth rag and the residue is then washed off with a water-soaked rag.

4. A method for removing paste ink from printing rollers and blankets, comprising:

(a) applying mineral oil to an inked surface of a printing roller or blanket, wherein said mineral oil has volatile organic content that is substantially 0% and si selected from the group of saturated hydrocarbon mineral oils that have a viscosity no higher than 165 SSU at 100° F. and a vapor pressure no higher than 0.1 mm Hg at 20° C.;

(b) allowing said mineral oil to coat said surface and penetrate the ink thereon;

removing material from said surface of the blanket or roller; and (c) applying additional portions of said mineral oil to the surface until the material that is removed from the surface of the roller or blanket is substantially clear.

5. A method according to claim 4, wherein paste ink is removed from printing rollers and wherein the blanket and roller wash is applied to the inked surface of the printing roller while the printing roller is turning, and wherein material is removed from the surface of the turning roller by engaging a clean-up device selected from the group consisting of doctor blades and wash-up sheets with the surface of the printing roller.

6. A method according to claim 4, wherein paste ink is removed from a printing blanket, and wherein the blanket and roller wash is applied to the inked surface of the printing blanket using a cloth rag.

* * * * *